United States Patent [19]

Dermond

[11] 4,039,265

[45] Aug. 2, 1977

[54] DITCH-SHAPING ROLL AND ATTACHMENT FOR A ROAD VEHICLE

[75] Inventor: Hartley P. Dermond, S. Venice, Fla.

[73] Assignee: William H. Clark, Sharon, Pa. ; a part interest

[21] Appl. No.: 639,114

[22] Filed: Dec. 9, 1975

[51] Int. Cl.[2] ..... E01C 19/26

[52] U.S. Cl. ..... 404/127; 37/DIG. 3

[58] Field of Search ..... 404/127, 128, 122; 37/DIG. 3; 172/518; 301/43

[56] References Cited

U.S. PATENT DOCUMENTS

| | | | |
|---|---|---|---|
| 499,514 | 6/1893 | Buchanan | 301/43 X |
| 690,893 | 1/1902 | McGuire | 404/127 X |
| 805,807 | 11/1905 | Moser | 404/128 |
| 975,457 | 11/1910 | Ransome | 404/127 X |
| 2,120,745 | 6/1938 | Greiner | 404/128 X |
| 2,243,251 | 5/1941 | Gustafson | 404/128 X |
| 2,891,335 | 6/1959 | Linneman | 404/127 X |
| 3,146,686 | 9/1964 | Grace | 404/128 X |
| 3,302,540 | 2/1967 | Fuentes | 404/127 |
| 3,680,452 | 8/1972 | Mangum | 404/127 |

*Primary Examiner*—Nile C. Byers

*Attorney, Agent, or Firm*—Lane, Aitken, Dunner & Ziems

[57] ABSTRACT

A roll and an attachment using such a roll are disclosed for a road vehicle for forming a ditch by pressure in a rolling motion or shaping a pre-existing ditch by the same coaction. The roll member includes a centrally-located cylindrical surface adapted to form or to shape the base surface of a ditch and opposed shaping surfaces located on the opposite sides of the cylindrical surface for forming or shaping the opposed sidewalls of the ditch. The shaping surfaces may be conical or curvilinear, for example. Means are disclosed for removably securing the roll member to a road vehicle, such as an earth grader. A method for using such a member for forming or shaping a ditch is also enclosed.

6 Claims, 5 Drawing Figures

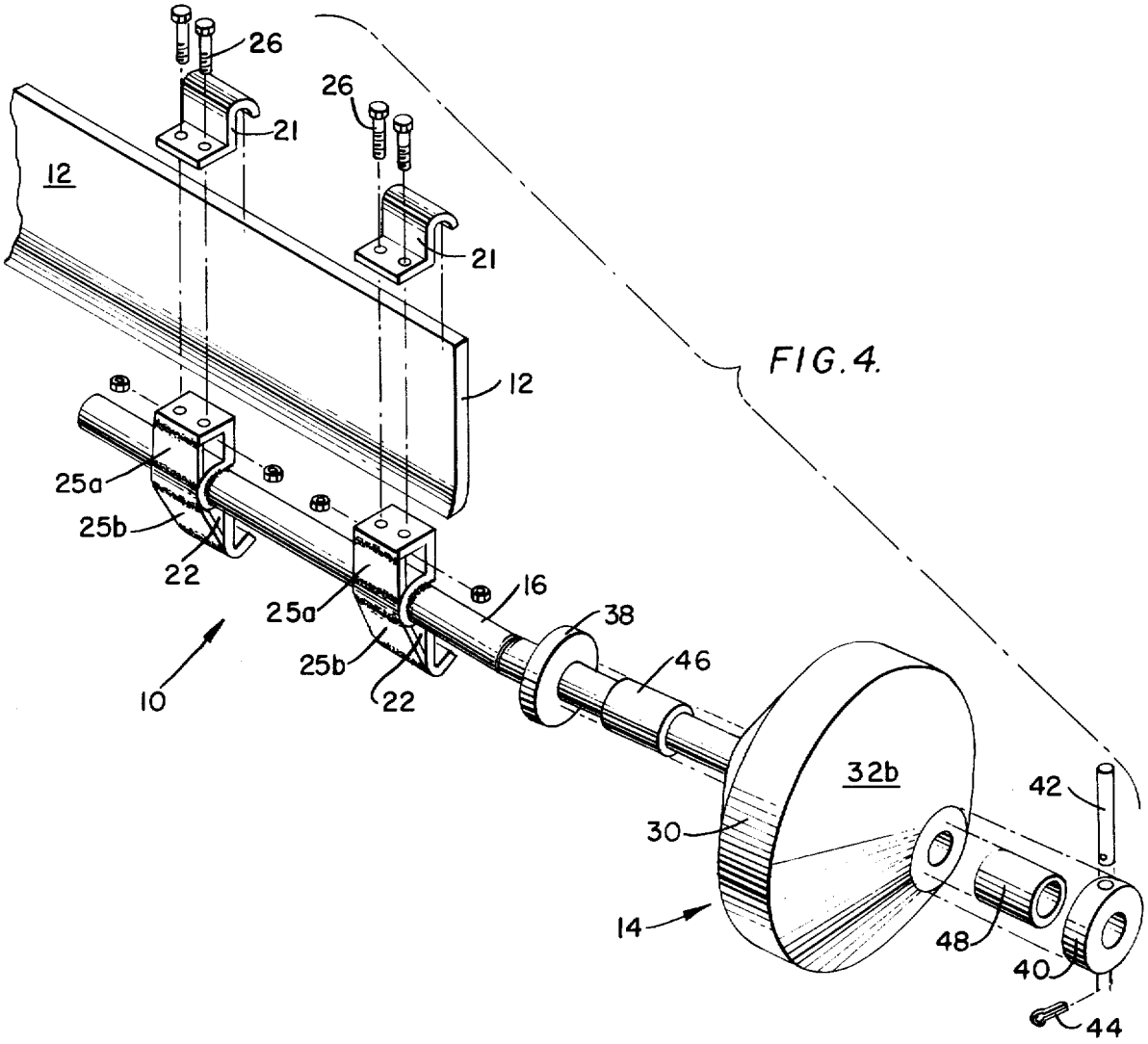
FIG. 4.
FIG. 5.
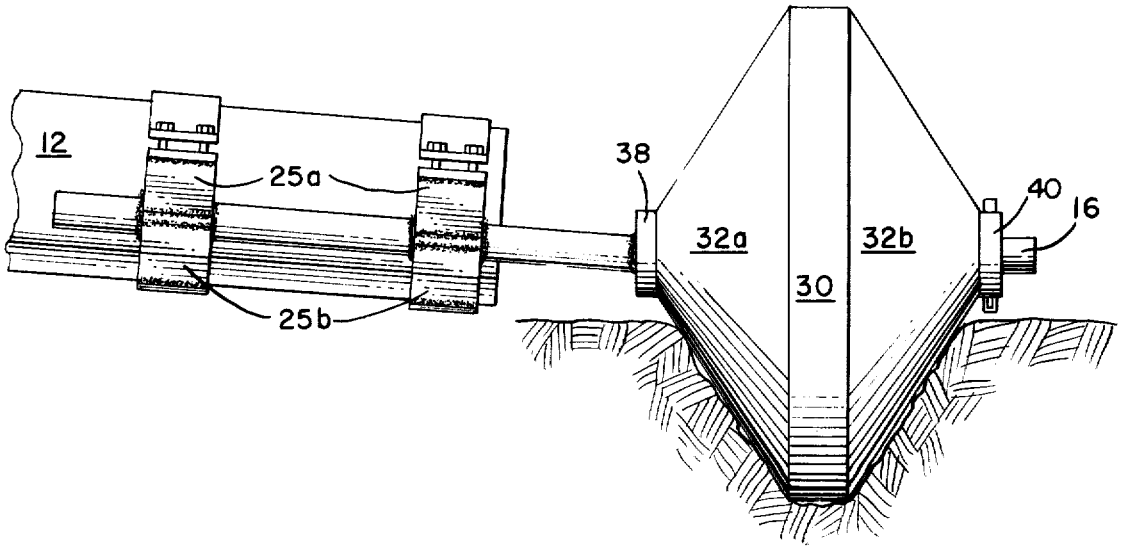

DITCH-SHAPING ROLL AND ATTACHMENT FOR A ROAD VEHICLE

BACKGROUND OF THE INVENTION

This invention relates to a roll member which preferably is adapted to be attached to a road vehicle for forming, shaping and compacting a ditch. More particularly, this invention relates to a trench or ditch shaper having a cylindrical surface for forming or shaping the base portion of a ditch and a pair of opposed shaping surfaces for forming or shaping the opposite sidewalls of the ditch. In addition, this invention also relates to a method for using a roll member of the type described in connection with road maintenance for forming the ditch or maintaining the shape of a pre-existing ditch or trench.

It has long been known that significant advantages arise from the use of drainage ditches dug in the earth, particularly along roadways, for the drainage of surface water and the like. In connection with road construction, for example, substantial attention is given to digging and shaping a ditch or trench adjacent the road by the removal of earth to the desired width and depth of the ditch or trench and hauling away the soil by a vehicle as it is dug or at some later date. Although the digging and hauling operations are quite expensive, these procedures have long been accepted as a necessary part of the method of producing ditches or trenches along the sides of the roadway.

In connection with such ditches, a number of problems arise, especially in populated areas, when roadside ditches are originally dug or redug during ditch maintenance. For example, the removal of soil from a ditch adjacent the road sometimes permits the road or street to sink significantly disrupting the contour of the road bed and perhaps causing some removal of dirt from the land of an adjacent property owner.

In addition, it is often necessary to recontour an existing ditch to improve the drainage capabilities as the soil, sand, or clay from the adjacent property begins to sink into the ditch or the silt deposited by the water draining through the ditch begins to affect adversely the drainage capability of the ditch. In order to alleviate these conditions, the roadside ditches or trenches are dug or redug to improve the drainage blocked by slit or weed growth and to re-establish the sides of the ditches which had been sliding in toward the base surface of the ditch from natural causes. Weed growth is often a significant difficulty in such ditch because drainage ditches usually retain water in the bottom area that contains humus, fertilizers and a significant portion of biological nutrients. This combination causes rapid growth of grasses and weeds that block the free flow of drainage water. In the past, it has been considered desirable to redig the ditches because of conditions such as those described above and to haul away the spoil. However, it has been found that each time this has been done, the street or road and adjacent property may be caused to sink accordingly. Therefore, it is a problem in the art to provide an apparatus for shaping the contour of a ditch, preferably without the removal of additional soil from the ditch.

The art has produced roller-type devices, including earth compacting roller means, which are adapted to be attached to or form a part of an earth loading machine. Such devices are shown in U.S. Pat. Nos. 3,680,452 and 2,120,745. Each of these devices is principally directed to an earth compacted device whose contemplated principal field of use is in compacting or rolling a narrow trench or ditch floor. Neither disclosure pays significant attention to shaping, compacting or otherwise working the sidewalls of a ditch by the disclosed device. On the other hand, U.S. Pat. No. 1,981,788, to Gardner, shows a bituminous ditch liner having a plurality of rollers, several of which are arranged to shape the sidewall contours of a ditch while rolling bituminous materials into the ditch bottom and sloping sidewalls. U.S. Pat. No. 690,893 discloses the use of a plurality of spaced conical ditch rollers for rolling a ditch between rows of crops. Despite the disclosures of these patents, it remains a problem in the art to produce a convenient roller member capable of both forming a ditch in the earth and compacting and shaping both the bottom surface and at least one sidewall of an existing ditch by the use of a convenient road vehicle. Moreover, it is an aim in the art to incorporate such a device in an attachment for a road vehicle such as a road grader.

It is thus a principal object of this invention to provide a device designed to both form a ditch in its entirety and to reshape an existing ditch, which device may preform the entire operation in one pass, particularly in those instances where the earth is not significantly compacted, without removal of additional earth. With the use of such a device, additional passes may be made for greater depth if and when necessary. By providing such a conveniently usable device to compress the ditch to the desired depth or width and compressing the sidewalls of the ditch to the desired angles, existing roots and plant growth will be compressed into the sides of the ditch to assist in the prevention of the creepage of soil and further fall-in and erosion of the sidewalls of the ditch. The periodic and repetitive compression of the ditch material will prevent the berm of the road and the pavement from moving toward and into the ditch.

As indicated, it is within the aims of this invention to perform the compressing and shaping operation without the removal of any significant further amount of material from the ditch. Not only does the failure to remove additional ditch material assist in alleviating the problems associated with the depression of adjacent earth surfaces, it also significantly reduces the cost of the operation by eliminating the need to haul away materials removed from the ditch. Moreover, the use of the device contemplated by this invention will assist in the prevention of the pavement of the road from breaking up and sliding into the ditch as seen in a number of roads. Still further advantages accrue from the invention in that adjacent property owners will not suffer the loss of soil either by operation of the device directly, or by loss of soil indirectly to replace that removed in a conventional ditch-shaping operation which utilizes earth removal as a salient portion.

These and other objects of the invention will become apparent from the detailed description of the invention taken in conjunction with the accompanying drawings.

BRIEF SUMMARY OF THE INVENTION

Directed to overcoming the shortcomings of the prior art and to achieving the aims and objectives described above, the apparatus according to the invention comprises a roll member and an attachment which incorporates such a roll member which attachment is secured to a road vehicle for shaping a ditch. The roll member includes a cylindrical portion having a surface axially-extending a predetermined length and at least one truncated shaping surface merging with the cylindrical surface. Peferably, the roll member includes a pair of such truncated shaping surfaces to provide a contour to the roll which is adapted to shape and compress both the base surface of a pre-existing ditch and the opposed sidewalls of that ditch, or to form and shape the base surface and sidewalls of a new ditch. The shaping surfaces may be conical, curvilinear, or of any other shape approximately matching the contour desired.

The roll member defines an opening therethrough to receive rotatably a roll axle contoured to permit the roll member to penetrate and compress the ditch earth or material while in a substantially vertical position when attached to a road vehicle, such as a road grader or other machine or mechanism. The axle, which forms part of the means for attaching the roll member to the road vehicle, may be rigidly secured, by way of example, to the blade of a road grader by clamping means which include a pair of removable clamping members. The roll axle is fixedly secured to the lower member of the clamping means while the upper clamping member is adapted to be secured to the upper edge of the grader blade and secured to the lower clamp member to secure the attachment rigidly to the road grader while permitting free rotation of the roll member within the ditch adjacent to the road.

Spaced collars are provided on the shaft to secure the roll member therebetween. Because the width of the rollers may vary for purposes to be discussed hereinafter, the inside collar is fixedly secured to the shaft while the outside collar is removably secured to the shaft. Bushings may be provided to locate roll members of varying widths centrally on the shaft for particular applications.

Thus, a significant advantage to the invention rests on the fact that an embodiment of the invention may be used to form and shape a new ditch in the earth where soil conditions permit and to shape and compact a pre-existing ditch for purposes of maintaining its contour.

BRIEF DESCRIPTION OF THE DRAWINGS

In the drawings:

FIG. 4 is an exploded perspective view of the components of the attachment; and

FIG. 5 is a side view of the apparatus according to the invention similar to FIG. 2 illustrating an alternative roller design having a significantly greater axial distance for wider ditches.

DETAILED DESCRIPTION OF THE PREFERRED EMBODIMENTS

Figure 1:
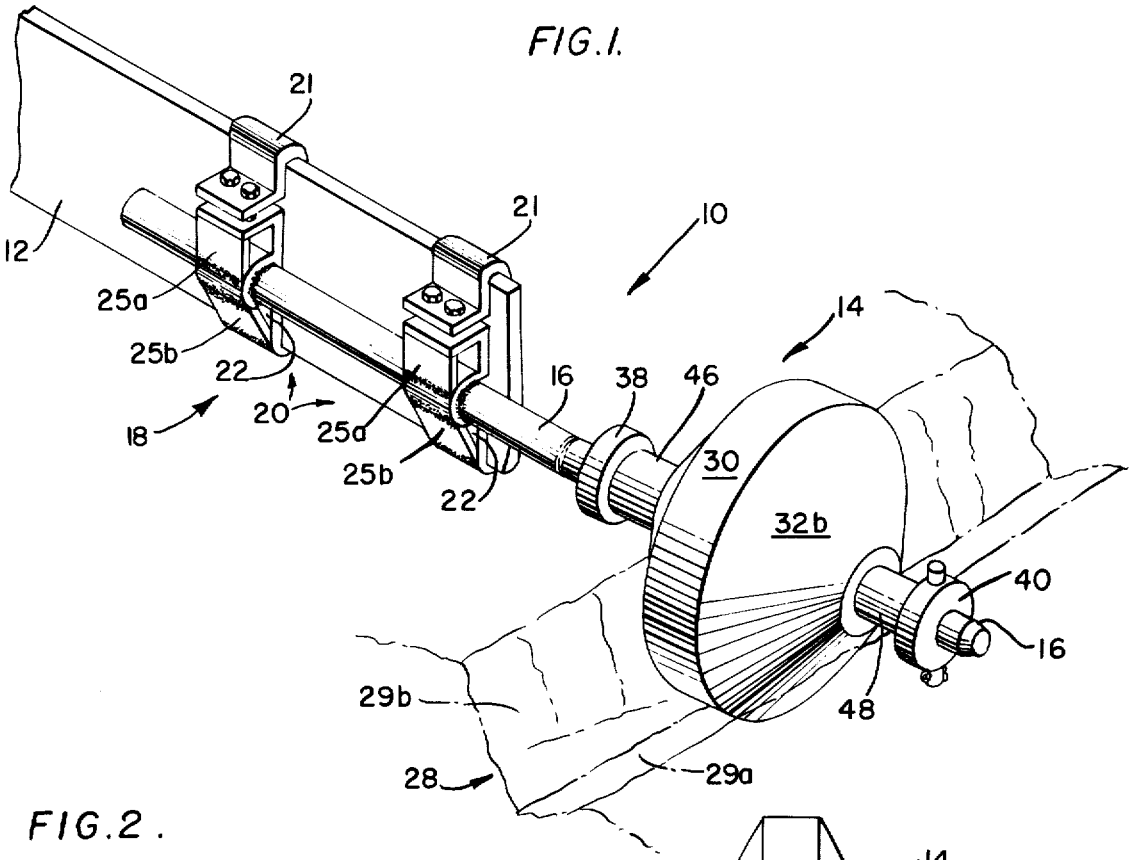
FIG. 1 is a perspective view of the apparatus according to the invention including the roll member rotatably affixed to a shaft which is fixedly secured to a grader blade for a road vehicle (not shown)

A shown in FIGS. 1, 2, 4, and 5, an attachment designated generally by the reference numeral 10 is shown secured to a grader blade 12 of a road vehicle (not shown). The attachment 10 includes a roll member designated generally by the reference numeral 14, rotatably secured on a roll shaft 16. The shaft 16 may be tapered at one end to facilitate insertion through the rod member 14. Means, designated generaly by the reference numeral 18, are provided for removably securing the roll shaft 16 to the grader blade 12.

Figure 3:
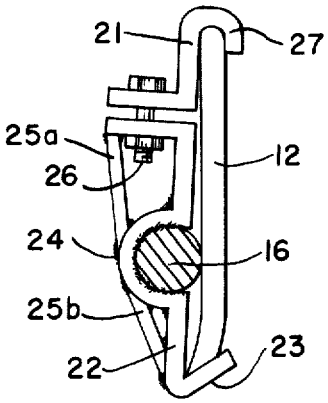
FIG. 3 is a cross-sectional view taken along line 3—3 of FIG. 2 showing the roll axle and the clamping members secured to the grader blade.

The attaching means 18 include a pair of clamps 20 each of which includes an upper clamp member 21 and a lower clamp member 22. As best seen in FIG. 3, the lower clamp member 22 includes a convoluted portion 23 at the lower portion thereof and having sufficient size and strength for enveloping securely the lower edge of the grader blade 12. The lower clamp member 22 also defines a loop portion 24 sized to envelop the roll shaft 16 to a sufficient extent to permit the roll shaft 16 to be retained therein such as by weldments as shown while yet permitting the alignment of the lower clamp member with the upper clamp member to be secured by a fastening member 26, such as a bolt and nut arrangement. The roll shaft 16 is preferably within the portion 24 of the lower clamp member 22. The clamp member 22 may also include support plate members 25*a* and 25*b* welded thereto for providing additional strength to the clamp under the pressures of use. The upper clamp member similarly includes an enveloping portion 27 of sufficient size and strength for engaging securely the upper portion of the grader blade 12. By removing the bolt 26, the upper and lower clamp members of each of the clamps 20 may be separated to permit the device to be removed or to be secured to the grader blade 12 in the field.

The attachment may also be attached to road vehicles other than road graders by appropriate modification of the details of the attaching mechanism. Moreover, modifications of the disclosed attachments may also be appropriate to attach the roll member and axle combination to a particular design of road grader. For example, additional support bracing between the axle 16 and the vehicle may be desirable or necessary.

The roll member 14 includes a centrally disposed shaping surface 30 which axially-extends a predetermined length and is adapted to compress and shape the base surface 29*a* of the ditch 28. The surface 30 is preferably cylindrical having a planar surface extent, although other surface shapes may be used to match the approximate shape of the ditch. The roll member 14 further includes a pair of opposed, truncated shaping surfaces 32*a* and 32*b* which merge with the surface 30 at about the opposed edges 33 and 34 thereof to impart a smoothing capability to the outer contour of the roll member 14. Preferably, the surfaces 32*a* and 32*b* are truncated conical surfaces (FIGS. 1, 4, and 5) which individually are defined by the frustrum of a right circular cone. However, other curvilinear surface shapes (for example, FIG. 2) may also be used. In any case, the contour of the surfaces 32*a* and 32*b* in large measure determines the ultimate contour of the ditch sidewalls 29*b*.

The roll member 14 is removably secured to the shaft 16 which is located in an opening 36 therein which extends axially through the roll 14. An inside collar 38 is fixedly secured, such as by welding, to the shaft 16, while an outside collar 40 is removably secured to the shaft 16 by means of a linch pin 42 and a removable cotter pin 44. A pair of bushings 46 and 48 are provided to locate the roll member 14 centrally between the collars 38 and 40. In practice, it is desired to offset the shaft 16 slightly to place the roll member 14 in a vertical position in the ditch.

The axial length of the shaping surface 30 may vary as required for specific applications. A ditch having a limited base surface 29*a* would preferably require a narrower shaping surface, while a ditch having a relatively wider base surface would preferably require a wider shaping surface 30. In a limited case, the shaping surface 30 may merely be defined by the conjuncture of the shaping surfaces 32*a* and 32*b* to provide a somewhat V-shaped roll member. In any case, the diameter of the shaping surface 30 defines the maximum diameter of the roll member 14.

Figure 2:
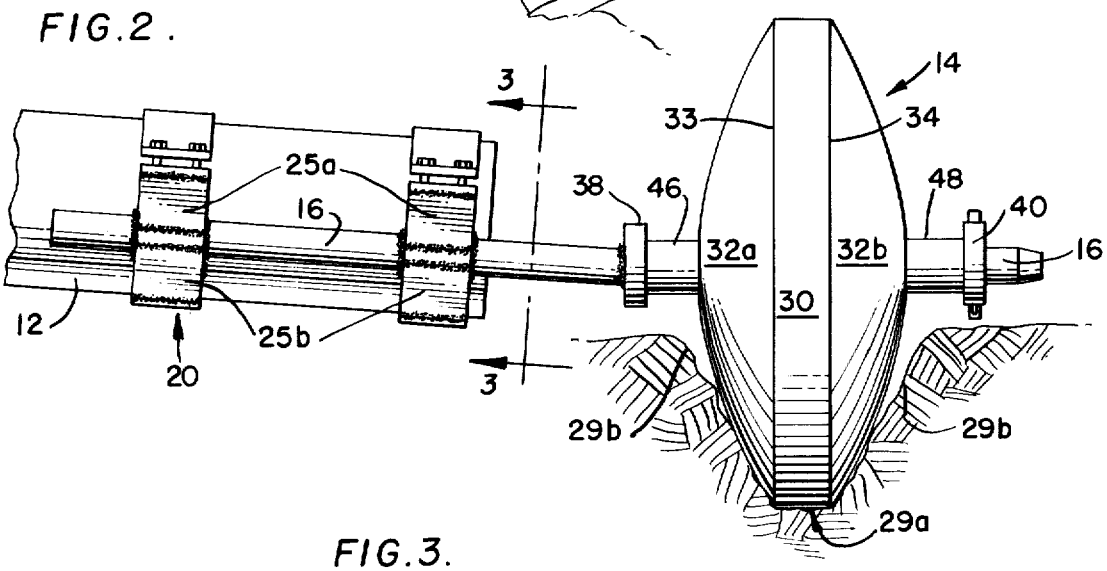
FIG. 2 is a frontal view of the apparatus according to the invention showing a narrower width roller of exerting a greater pressure with the least feasible effort on the base surface of the ditch for increased compacting, especially when making a new ditch.

Also, because of a great variety of soil conditions to be compressed by the rolling operation, rolls of varying axial lengths having cylindrical surfaces 30 of varying axial lengths may be required. Thus, FIGS. 2 and 5 illustrate two specific examples, the former illustrating a narrower roll while the latter illustrates a wider roll. The embodiment of FIG. 2, for example, illustrates a narrow roll 14 which has a greaater penetration power and permits a concentration of compressive forces by the cylindrical surface 30 on the base surface 29*a* of the ditch 28. The depth of penetration is determined by the adjustment of the downward pressure applied to the grader blade 12 by the vehicle, as well as by the weight of the roller desired. For example, the roll member 14 could be made of substantial weight requiring less downward pressure by the road vehicle. For purposes of dimensional comparison, the roll of FIG. 2 may be approximately eight inches wide at the cylindrical surface 30 and about 18 inches wide measuring between the apexes of the truncated conical portions 32*a* and 32*b.* A typical diameter contemplated for the roll member is about 6 feet.

On the other hand, the roll member 14 shown in FIG. 5 is shaped or contoured to measure about 8 inches wide at the cylindrical surface 30 and approximately 36 inches wide between the apexes of the truncated conical portions 32*a* and 32*b.* The contour of the roll member 14 shown in FIG. 5 is designed to produce a concentration of forces on the sides 29*b* of the ditch, while the contour of the roll shown in FIG. 2 is designed to produce a concentration of forces on the base surface 29*a* of the ditch.

The rollers may be manufactured by any suitable material, such as steel plate having a welded construction. The opening through the roll member 14 may be defined by a bushing extending through the roll member and made from heavy tubing approximately eight inches outside diameter and four inches inside diameter. This bushing (not shown) is securely welded within the roll. As a commercial matter, it is anticipated that the truncated conical or curvilinear surfaces may be provided by utilizing commercially available tank tops.

In operation, the attachment according to the invention is secured to the grader blade 12 and the vehicle is caused to pass along the road adjacent to the ditch or trench in such a manner as to orient the roll member 14 appropriately within the ditch. The downward force on the grader blade is selected to achieve the degree of compression or compaction on the ditch which may be desired and in certain circumstances it may be necessary to make a plurality of passes along the ditch. For example, the first pass may be made with the narrower roll member 14 as shown in FIG. 2 while a later pass is made with the wider shaper as shown in FIG. 5.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A device for simultaneously forming, shaping and compacting both the sidewalls and the base of a ditch comprising:

a roll member which includes a pair of spaced, opposed, sidewall shaping surfaces, said shaping surfaces being adapted to shape and compress the opposed sidewalls of the ditch, said shaping surfaces being joined to form another shaping surface adapted to shape and compress the base surface of the ditch;

a shaft rotably supporting said roll member adjacent to one end portion of said shaft; and attachment means disposed adjacent the other end portion of said shaft for removably securing said shaft and said roll member to a road vehicle which is able to cause said roll member to traverse the ditch, said attachment means including a clamping member fixedly disposed on said shaft, arcuate engagement surfaces on said clamping member for holding engagement with the road vehicle, and means for securing said clamping member to the road vehicle.

2. The device as set forth in claim 1 wherein at least one of said sidewall shaping surfaces is a conical surface.

3. The device as set forth in claim 1 wherein at least one of said sidewall shaping surfaces is a curvilinear surface.

4. The device as set forth in claim 1 wherein said another shaping surface is a cylindrical surface axially extending a predetermined length between said sidewall shaping surfaces, the diameter of said cylindrical surface defining the maximum diameter of said roll member.

5. The device as set forth in claim 1 wherein said clamping member comprises two separate elements, each element having an arcuate engagement surface, and said shaft is fixedly disposed on one of said elements, and said securing means includes adjustable means interconnecting said elements of said clamping member.

6. An attachment for a road vehicle for forming, shaping and compacting a ditch, said attachment comprising:

a roll member which includes a cylindrical shaping portion having a surface extending axially a predetermined length, said axial surface being adapted to shape and compress the base surface of a ditch, and two, spaced, opposed truncated shaping surfaces merging with said cylindrical surface at the peripheral edges thereof, said truncated surfaces being adapted to shape and compress the sidewalls of the ditch; and means for removably securing said roll member to the road vehicle, said means including: a roll axle extending at one end portion through axial openings provided at about the apexes of said truncated shaping surfaces; a segmented clamping member having one segment fixedly disposed on said roll axle; an arcuate engagement surface on each segment of said clamping member for holding engagement with the road vehicle; and adjustable means interconnecting said segments of said clamping member for securing said roll axle to the road vehicle.

* * * * *